US005133557A

United States Patent [19]

Sugimoto

[11] Patent Number: 5,133,557

[45] Date of Patent: Jul. 28, 1992

[54] GOLF PRACTICING APPARATUS

[76] Inventor: Akitoshi Sugimoto, 244 Mama, Kochi-shi, Kochi, Japan

[21] Appl. No.: 745,933

[22] Filed: Aug. 16, 1991

[30] Foreign Application Priority Data

Aug. 20, 1990 [JP] Japan ..... 2-87089[U]
Oct. 5, 1990 [JP] Japan ..... 2-105583[U]

[51] Int. Cl.[5] ..... A63B 57/00
[52] U.S. Cl. ..... 273/201; 273/195 B
[58] Field of Search ..... 273/201, 176 H, 35 R, 273/195 R, 195 B, 196, 197 R, 197 A

[56] References Cited

U.S. PATENT DOCUMENTS

| | | | |
|---|---|---|---|
| 2,696,985 | 12/1954 | Hogeberg | 273/201 |
| 3,549,152 | 12/1970 | Gentiluomo | 273/201 |
| 4,181,309 | 1/1980 | Atkinson et al. | 273/201 |
| 4,659,081 | 4/1987 | Cook | 273/201 |
| 4,815,774 | 3/1989 | Diamandis | 273/201 |

*Primary Examiner*—Theatrice Brown
*Attorney, Agent, or Firm*—Weiser & Stapler

[57] ABSTRACT

The improved golf practicing apparatus has a vertical slider unit that comprises an outer tube, an intermediate tube and an inner tube that are slidably fitted over one another in that order in such a way that the hole in the floor surface can be completely closed with the top surface of the intermediate tube. The apparatus repeats automatically a cycle that consists of automatically supplying a golf ball onto the tee mounted on the inner tube, automatically raising the tee above the floor by a drive mechanism, lowering the tee after hitting the ball on it, placing the next ball on the tee and raising the tee again. The apparatus may be adapted to have the capability of adjusting the height of the tee after it is raised above the floor. It may also be adapted to tilt the floor by a desired angle of inclination. The fairly large hole that is formed in the area where balls are teed up in the prior art golf practicing apparatus is completely closed in the improved apparatus, so the hole is not at all obtrusive to the player who is about to hit the ball. The damage to the club and hands of the player which would otherwise occur if the hole where exposed can be effectively prevented by the improved apparatus. If the apparatus has capabilities for adjusting the height of the tee and the inclination of the floor, the player can practice hitting balls with various types of clubs including woods and irons under substantially the same condition as in an actual golf course.

17 Claims, 12 Drawing Sheets

GOLF PRACTICING APPARATUS

BACKGROUND OF THE INVENTION

This invention relates to an apparatus for teeing up balls in the practice of golf. More particularly, this invention relates to a golf practicing apparatus that enables a ball to be automatically teed up on a flat floor without forming an exposed hole in its surface through which the tee and the ball are moved up and down. Even if the player hits the floor surface with an iron while striking the teed up ball, he will not receive excessive impact on the hands and, hence, he is capable of effective practicing of golf not only with woods but also with irons.

While various kinds of apparatus for teeing up balls are used in a golf practicing yard, one that is capable of automatically teeing up balls is on increasing demand today. This type of apparatus is often constructed in such a way that a ball placed on the tee is raised through a hole made in the floor surface. After the ball is hit, the tee descends and the next ball is placed on it and subsequently raised to the hitting position. The sequence of these steps is repeated as many times as are necessary.

A problem with this prior art apparatus for automatically teeing up golf balls is that the hole made in the floor surface through which a ball and the tee are moved will prevent effective striking of balls. Such holes do not exist in actual golf courses. In addition, when the player hits the ball with an iron, he will unavoidably hit the underlying lawn grass or soil and this makes it necessary for the practicing player to strike the bottom of the ball. In this situation, it is unavoidable for the player practicing with the prior art apparatus to hit the top edges of the hole. Not only does this prevent the player from striking the ball smoothly but it also exerts excessive impact on his hands and causes damage to the club he is using. Therefore, practicing with irons has been impossible to perform effectively with the prior art apparatus for automatically teeing up balls. A further problem is that the hole will unavoidably come into the view of the player when he hits the ball, which is far from the situation that normally occurs in actual golf courses.

SUMMARY OF THE INVENTION

The present invention has been accomplished under these circumstances and has an object providing a golf practicing apparatus that enables a ball to be automatically teed up on a flat floor without forming an exposed hole in its surface through which the tee and a ball are moved up and down. Even if the player hits the floor surface with an iron while striking the teed up ball, he will not receive excessive impact on the hands and, hence, he is capable of effective practicing of golf not only with woods but also with irons.

Another object of the present invention is to provide a golf practicing apparatus that is capable of automatically adjusting the height of the tee and that is also adapted to tilt the floor in such a way that the practicing player is capable of hitting balls under a condition that simulates slopes in an actual golf course.

According to its first aspect, the present invention provides a golf practicing apparatus that comprises:

(1) a vertical slider unit that is mounted in a through-hole in a floor and that is capable of vertical movement between the lowest position where a golf ball is supplied and the hitting position;

(2) a means of driving said slider unit to move up and down; and (3) an automatic control unit that performs sequence control on the vertical movement of said slider unit;

said slider unit having:

(a) an outer tube that is open at both ends, that is positioned below the through-hole in the floor when it is in said lowest position, and the top surface of which contacts the floor when it is in said hitting position;

(b) an intermediate tube that is slidably fitted into said outer tube, that is open at the bottom and closed at the top, with the closed top having an orifice and forming a surface that is flush with the top surface of the floor when said slider unit is in said hitting position; and (c) an inner tube that is slidably fitted into said intermediate tube, that is open at the bottom and closed at the top, with the closed top having a tee that is fitted in such a way that it will protrude through the orifice in said intermediate tube;

said automatic control unit controlling said slider unit to move through successive cycles of the following steps: descending to the lowest position where a ball can be placed on the tee in the outer tube; starting to ascend when the ball is placed on the tee in said position; the outer tube first stopping upon contact with the floor; the intermediate tube then stopping when it provides a surface that is flush with the floor surface; the tee on the inner tube finally stopping when it projects above the floor surface; and the slider unit descending to said lowest position after the ball on the tee is struck.

According to its second aspect, the present invention provides a golf practicing apparatus that comprises:

(1) a floor having a through-hole;

(2) a vertical slider unit that is mounted in the through-hole in said floor and that is capable of vertical movement between the lowest position where a golf ball is supplied and the hitting position;

(3) a means of driving said slider unit to move up and down;

(4) a means of automatically supplying a golf ball to said slider unit;

(5) an automatic control unit that performs sequence control on the vertical movement of said slider unit;

said slider unit having:

(a) an outer tube that is open at both ends, that is positioned below the through-hole in the floor when it is in said lowest position, and the top surface of which contacts the floor when it is in said hitting position;

(b) an intermediate tube that is slidably fitted into said outer tube, that is open at the bottom and closed at the top, with the closed top having an orifice and forming a surface that is flush with the top surface of the floor when said slider unit is in said hitting position; and (c) an inner tube that is slidably fitted into said intermediate tube, that is open at the bottom and closed at the top, with the closed top having a tee that is fitted in such a way that it will protrude through the orifice in said intermediate tube;

said automatic control unit controlling said slider unit to move through successive cycles of the following steps: descending to the lowest position where a ball can be placed on the tee in the outer tube; starting to ascend when the ball is placed on the tee in said position as it is supplied from said ball supply means; the outer tube first stopping upon contact with the floor; the intermediate tube then stopping when it provides a surface that is flush with the floor surface; the tee on the inner tube finally stopping when it projects above the floor surface; and the slider unit descending to said lowest position after the ball on the tee is struck.

In a preferred embodiment of the present invention, a patch of artificial lawn grass is detachably provided on the closed top of the intermediate tube. In another preferred embodiment, the tee is detachably provided on the closed top of the inner tube.

In still another embodiment of the present invention, the golf practicing apparatus further includes a means of adjusting the height of the tee on the inner tube after it projects above the floor surface. In a more preferred embodiment, the tee is in a tubular form and the apparatus has a means of sucking a golf ball through the interior of this tubular tee. The vertical slider unit preferably has a guide tube for guiding the outer, intermediate and inner tubes.

The golf practicing apparatus according to the second aspect of the present invention preferably has a means of tilting the floor. In a most preferred embodiment, this floor tilting means is composed of a ball joint that supports the floor below the tee on the inner tube of the slider unit and an extending/retracting means that is provided on the floor at two points ahead of the player standing on the floor.

The prior art golf practicing apparatus has a hole in the floor surface through which the tee and a ball are moved up and down. This hole is not only obtrusive to the player when he hits the ball; the player will also strike the top edges of the hole with a club, especially an iron, exerting excessive impact on his hands and causing substantial damage to the club. On the other hand, the apparatus of the present invention closes the hole in the floor and uses a tee that is as small as tees that are used on actual golf courses. Further, the floor of the apparatus can be adapted to be inclined as required, so the player can practice golf under conditions that simulate play in an actual golf course.

DESCRIPTION OF THE PREFERRED EMBODIMENTS

The golf practicing apparatus of the present invention is described below in greater detail with reference to the preferred embodiments shown in the accompanying drawings.

The golf practicing apparatus of the present invention is capable of teeing up golf balls either automatically or semi-automatically and it may be detachably or permanently mounted in a through-hole 2 in the floor 1. A patch of artificial lawn grass 3 is preferably laid down on the floor 1. The through-hole 2 is equipped with a stopper 4.

Figure 1:
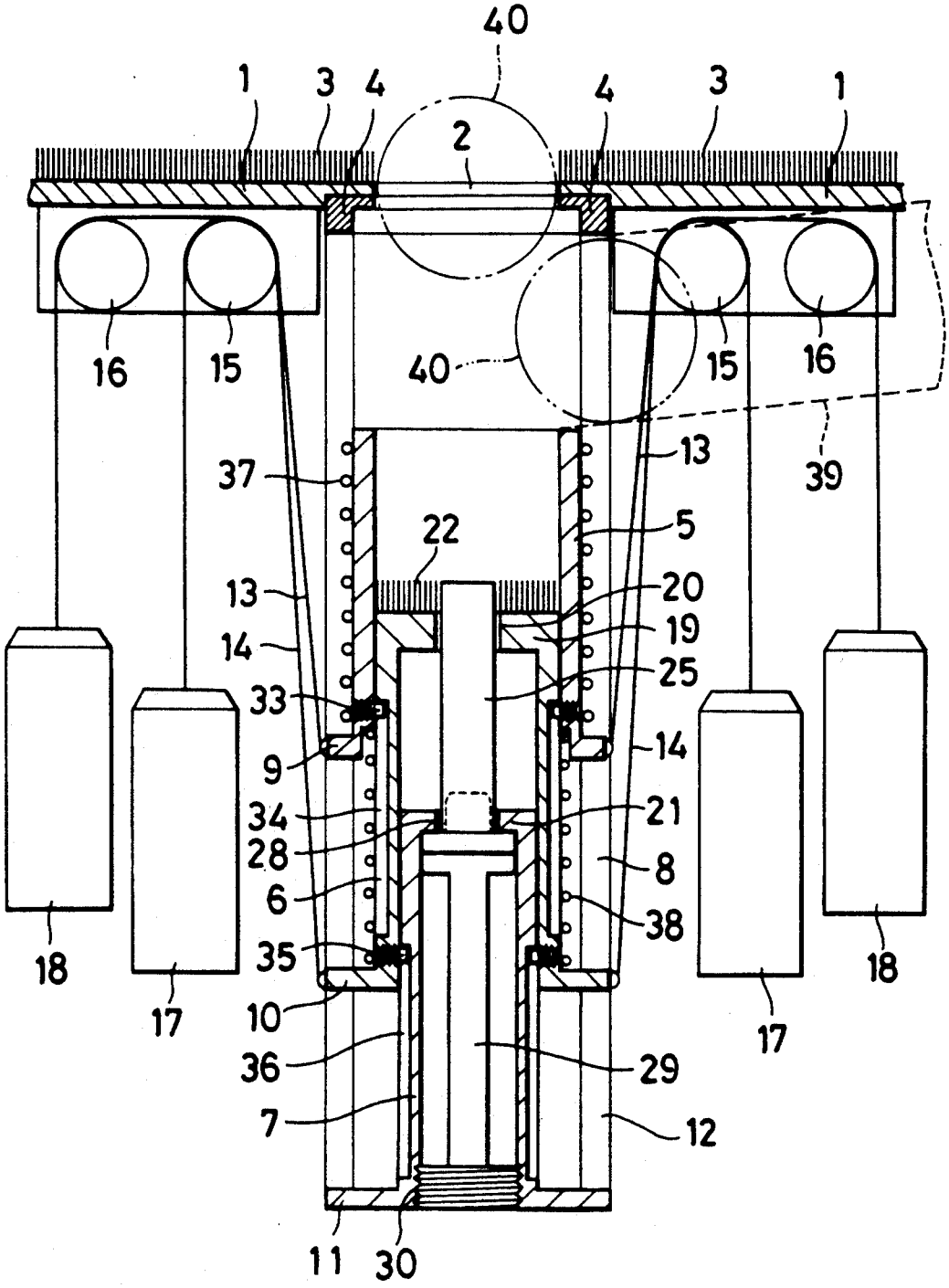
FIG. 1 is a side view, in partial cross section, of a preferred embodiment of the golf practicing apparatus of the present invention with the vertical slider unit being in the lowest position.

As shown in FIG. 1, the golf practicing apparatus of the present invention has a vertical slider unit that is composed of an outer tube 5 that is open at both ends, an intermediate tube 6 that is slidably fitted into the outer tube 5, and an inner tube 7 that is slidably fitted into the intermediate tube 6. Preferably, the outer, intermediate and inner tubes are moved up and down through a guide tube 8. Vertical movement through the guide tube 8 can conveniently be accomplished by permitting flanges 9, 10 and 11 on the respective tubes to be guided along grooves 12 formed in the surface of the guide tube.

The outer and intermediate tubes 5 and 6 are given a force acting in an upward direction by means of weights 17 and 18 that are linked to the respective flanges 9 and 10 via wires 13 and 14 that are wound around associated pulleys 15 and 16. The outer, intermediate and inner tubes, the guide tube, the weights and other components of the vertically moving mechanism are preferably made of rust-proof materials.

The intermediate tube 6 is open at the bottom but is closed at the top 19 which has an orifice 20 bored in the center. The inner tube 7 is also open at the bottom but closed at the top 21.

Figure 3:
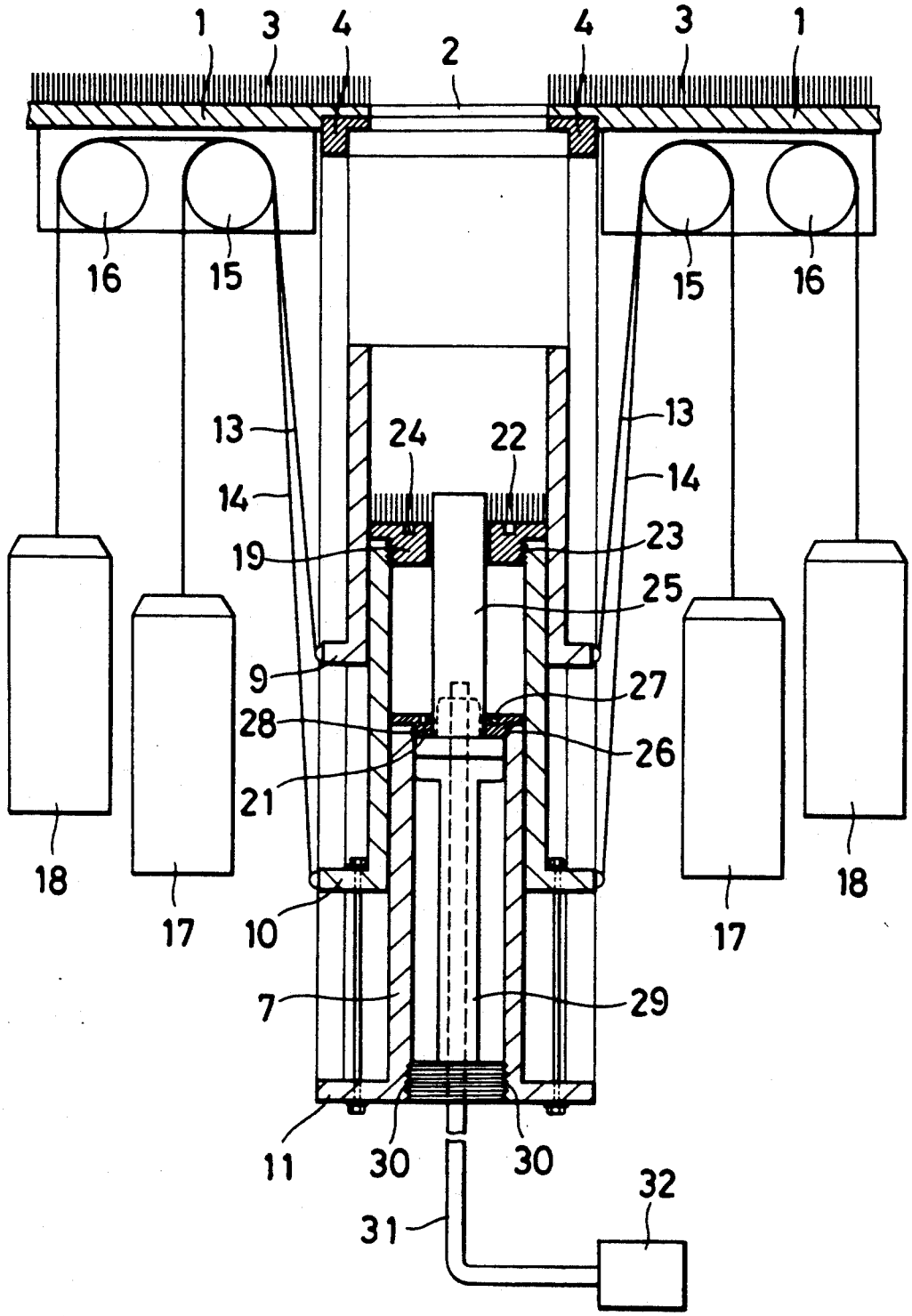
FIG. 3 is a side view, in partial cross section, of another embodiment of the golf practicing apparatus of the present invention.

A patch of artificial lawn grass 22 that is the same as the artificial lawn grass 3 laid down on the floor 1 is preferably provided on the closed top 19 of the intermediate tube 6. The patch of grass 22 is advantageously replaceable with a new one since it is subject to damage upon frequent application of impact by hitting with clubs such as irons and woods. The patches of grass 3 and 22 are conveniently bonded with an adhesive. A preferred adhesive is a thermoplastic one that can be bonded and detached by heating as with a burner. To this end, the closed top 19 onto which the patch of artificial lawn grass 22 is attached is preferably made detachable, as typically shown in FIG. 3. In FIG. 3, the closed top 19 is shaped like a lid on the intermediate tube 6 and may be threadable with a screw 23. To facilitate threading, grooves 24 may preferably be formed on the upper surface of the closed top 19.

A tee 25 is secured to the closed top 21 of the inner tube 7 in such a way that the distal end of the tee will project through an orifice 20 formed in the closed top 19 of the intermediate tube 6.

As in the case of the patches of artificial lawn grass 3 and 22, the tee is also subject to damage upon frequent application of impact by hitting with clubs such as irons and woods, so that the tee is preferably replaceable with a new one. An example of the replaceable tee is also shown in FIG. 3, in which the closed top 21 is shaped like a lid on the inner tube 7 and may be threadable with a screw 26. To facilitate threading, grooves 27 may preferably be formed on the upper surface of the closed top 21. An orifice 28 is formed in the closed top 19 and the tee inserted through the orifice 28 is secured from below to the inner tube 6 by means of a support 29. The tee support 29 and the inner tube 7 may preferably be coupled in such a way that the tee 25 can be tightly secured to the closed top 21 of the inner tube 7 by means of a screw 30.

The tee 25 is a hollow tube that is formed of a flexible material such as soft rubber. Preferably, a flexible pipe 31 extending from the bottom of the tee is connected to an evacuating device 32, as shown in FIG. 3, to insure that a ball placed on the tee will be sucked. This arrangement is preferred since an automatically teed up ball will not drop from the tee. Any commercial evacuating devices such as a vacuum pump and a vacuum ejector can be used satisfactorily. If desired, the tee support 29 may also be a hollow tube that is connected to the pipe 31 leading to the evacuating device 32.

Figure 2:
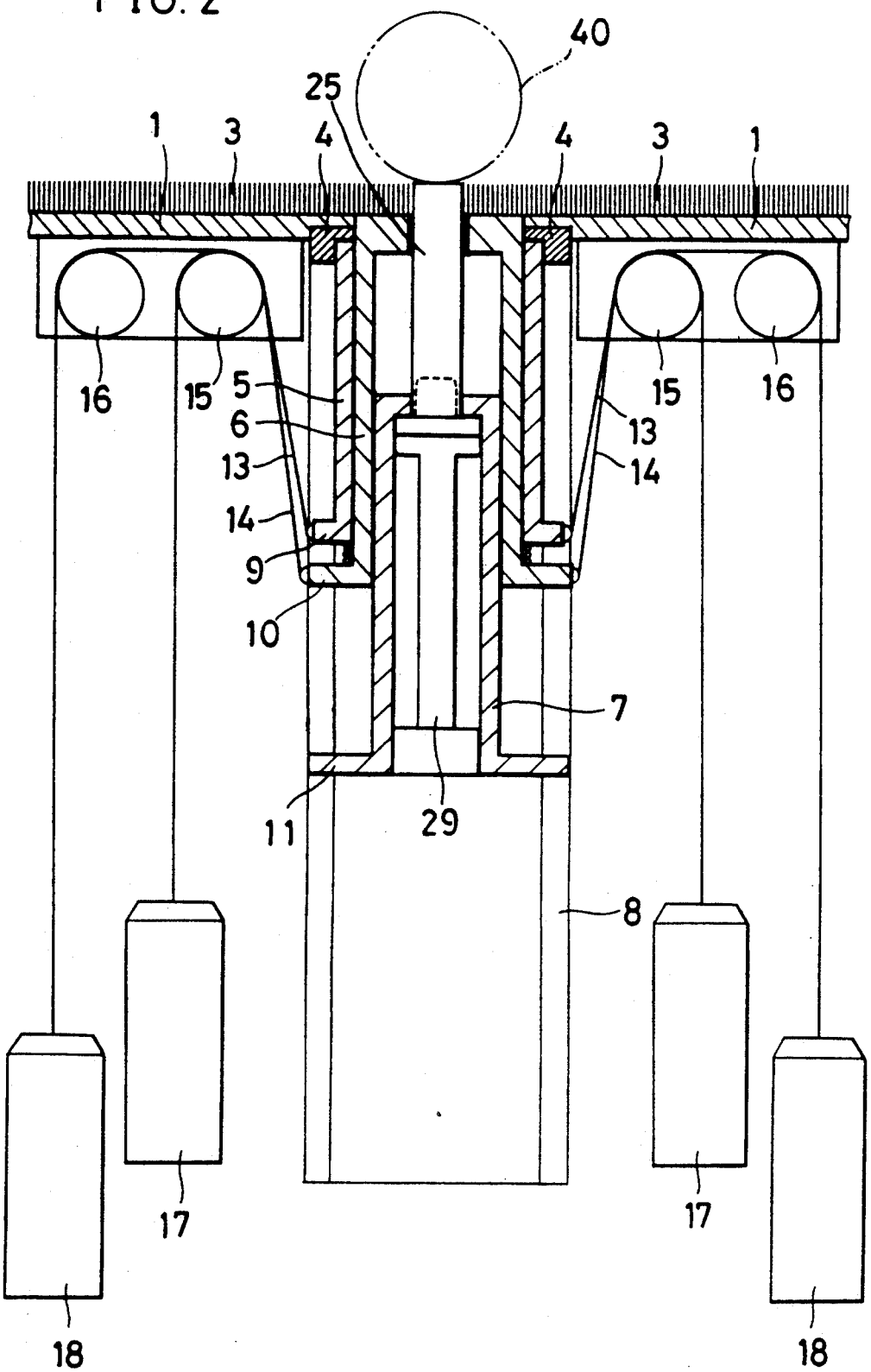
FIG. 2 is a side view, in partial cross section, of the same golf practicing apparatus with the vertical slider unit being in the hitting position.

In the golf practicing apparatus of the present invention, the vertical slider unit described above takes on vertical movements between the lowest position shown in FIG. 1 at which a golf ball is supplied and the ball hitting position shown in FIG. 2. The slider unit is preferably adapted in such a way that the outer, intermediate and inner tubes will not slip out of one another during vertical movement. The most convenient way to prevent those tubes from slipping out of one another is engaging two adjacent tubes by a ratchet-groove mechanism as shown in FIG. 1, in which the outer, intermediate and inner tubes 5, 6 and 7 are held in mutual engagement by means of a small screw 33 mounted on the outer tube 5, a groove 34 that is formed in the surface of the intermediate tube 6 for defining the range over which the small screw 33 can move, a small screw 35 mounted on the intermediate tube 6, and a groove 36 that is formed in the surface of the inner tube 7 for defining the range over which the small screw 35 can move.

Another way to prevent the three tubes from slipping out of one another is linking the flanges of two adjacent tubes by suitable means such as pins and wires of predetermined lengths.

When the vertical slider unit ascending from the lowest position shown in FIG. 1 to reach the hitting position shown in FIG. 2, the top of the outer tube 5 contacts the stopper 4 beneath the floor 1 and the flange 10 of the intermediate tube 6 contacts the flange 9 of the outer tube 5 while, at the same time, the closed top 19 of the intermediate tube 6 reaches the through-hole 2 in the floor 1 to provide a surface that is flush with the top surface of the floor 1, whereby the through-hole 2 is completely closed so that it is invisible to the eye of the player. In this case, the tee 25 on the inner tube 7 will project to lie above the through-hole 2 in the floor 1. Since the through-hole which would otherwise come into the view of the player in the prior art apparatus is entirely invisible, the player will not be detracted from his practice by the hole and, instead, he can concentrate on hitting balls without worrying about excessive impact to his hands or damage to this clubs which would occur if he hit the top edges of the hole.

As will be understood from the above description, the components of the vertical slider unit will collide with one another while it is ascending to the hitting position. Desirably, the impact or mechanical noise that result from such collision are as small as possible. To meet this need, an impact attenuating buffer device is preferably used, as is typically shown in FIG. 1, in which the outer tube 5 is furnished with a coil spring 37 in such a way that it will contact the bottom of the stopper 4 before the top of the outer tube 5 contacts the stopper, and the intermediate tube 6 is furnished with a coil spring 38 between the flange 10 and the flange 9 of the outer tube 5 so that the two flanges will contact each other softly.

A gold ball is placed on the tee when the vertical slider unit is in the lowest position shown in FIG. 1, to which a drive means to be described in detail hereinafter has lowered the slider unit in counteraction against the weights 17 and 18 so that the small screw 33 on the outer tube 5 will engage the top end of the groove 34 in the surface of the intermediate tube 6 whereas the small screw 35 on the intermediate tube 6 will engage the top end of the groove 35 in the surface of the inner tube 7.

In the lowest position shown in FIG. 1, the player may drop a golf ball 40 into the through-hole 2 in the floor 1 with his fingers or the head of his club so that it rests on the tee 25. However, golf balls are advantageously supplied onto the tee 25 by means of an automatic feeder. If golf balls 40 are to be supplied automatically, an automatic feeder 39 is preferably installed below the floor 1 as indicated by dashed lines in FIG. 1. Many types of automatic ball feeders are currently commercially available and some are described in pending patent applications and any of those automatic feeders may be used as appropriate. To name only a few examples, the models disclosed in Japanese Patent Application (kokai) Nos. 5772/1988 and 222782/1988 may be used with advantage.

In order to insure that the vertical slider unit is automatically moved up and down while golf balls are also supplied automatically, it is necessary to detect at least two events, i.e., the supply of a ball in the lowest position and the presence or absence of a teed up ball on the tee. In both cases, the presence or absence of a ball is most advantageously detected by an optical means using light-emitting and light-receiving devices. Alternatively, other various sensing switches that are also used in the existing golf practicing apparatus may be adopted to detect the presence or absence of a ball.

In the apparatus of the present invention, the supply of a ball in the lowest position of the slider unit which is shown in FIG. 1 may be detected at various positions as by a sensing means mounted at the entrance of the automatic feeder 39 leading to the guide tube 8, a sensing means mounted on the inner surface of the outer tube 5, or by a sensing means mounted within and on the ceiling of the tee 25. No such sensing means is shown in FIG. 1 but all that is needed is that the supply of a ball into the slider unit at any one of the positions mentioned above should be detected.

To detect the presence or absence of a teed up ball in the hitting position shown in FIG. 2, the use of an optical means of the type described in the preceding paragraph is optimal. Such an optical means may be designed in various manners; in one design, a light-emitting device and a light-receiving device are provided on the floor in such a way that when a ball is on the tee, the light-receiving device receives the reflected light from the ball whereas no light is received if there is no ball on the tee. Alternatively, the light emitted from the light-emitting device may be blocked by a ball on the tee whereas it is received by the light-receiving device if there is no ball on the tee.

The height of the tee carrying a teed up ball 40 in the hitting position shown in FIG. 2 will vary depending on the type of club to be used. If a wood is to be used, the tee is adjusted to be higher than in the case of using an iron. To cope with this situation, the apparatus of the present invention may be adapted to allow for adjustments in the height of the tee in the hitting position, as typically shown in FIG. 4. A means 43 composed of a light-emitting device 41 and a light-receiving device 42 is provided on the floor surface to control the height of the tee. The light-emitting device 41 and the light-receiving device 42 are connected to an automatic control unit 44. The automatic control unit 44 is used to perform automatic sequence control on the various operations already described above and those which will be described hereinafter. The automatic control unit 44 is optimally composed of a microcomputer.

Figure 4:
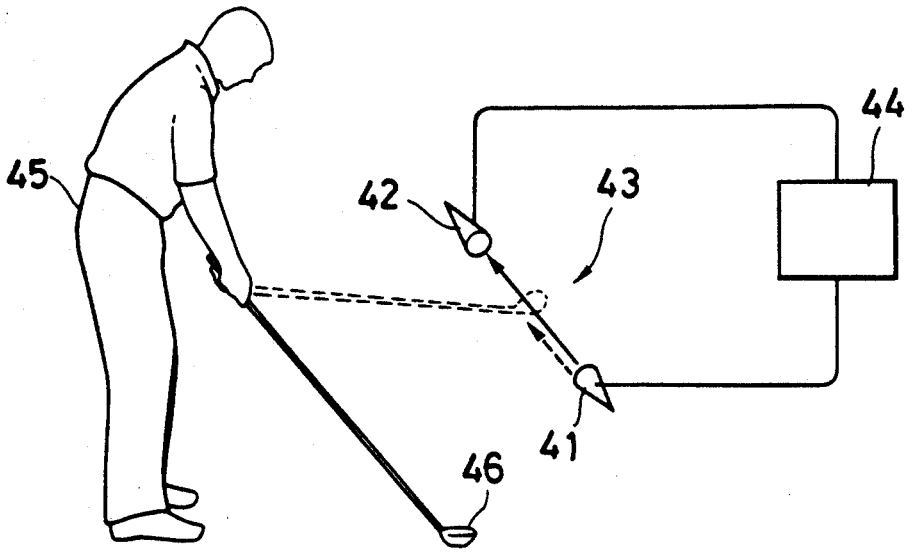
FIG. 4 is a diagram illustrating the mechanism of adjusting the height of the tee.

FIG. 4 shows the case where the player 45 uses the head 46 of his club to control the height of the tee. When the head 46 is not put between the light-emitting device 41 and the light-receiving device 42 as indicated by a solid line, the light emitted from the device 41 is admitted unimpeded into the light-receiving device 42 as also indicated by a solid line; in this case, the control unit 44 operates in such a way that the tee will take on the hitting position of a predetermined height or the height set for the previous hitting step. If, on the other hand, the head 46 is put between the light-emitting device 41 and the light-receiving device 42 as indicated by a dashed line, the light emitted from the device 41 is blocked by the head 46 and will not be admitted into the light-receiving device 42 as also indicated by a dashed line; in this case, the control means 43 performs control in such a way that a drive means (to be described hereinafter) will cause the inner tube 7 to either ascend or descend for changing the height of the tee, in the hitting position. Through visual check, the player will adjust the height of the tee in accordance with the type of club he is going to use. When the desired height of the tee is obtained, he may remove the head 46 of his club from between the light-emitting device 41 and the light-receiving device 42, whereupon the tee stops at the selected height and the player can hit the ball on the tee.

In actual golf courses, the ground is usually not level but is often inclined in one way or another. The golf practicing apparatus of the present invention has the added advantage that it can simulate the hitting of a ball on such a sloping surface, as typically shown in FIG. 5, in which the situation where the player hits a ball downhill in the toe direction is indicated by a one-long-and-one-short dashed line and the situation where the player hits uphill in the toe direction is indicated by a one-long-and-two-short dashed line. The surface of the floor 1 may be inclined by a desired angle by properly controlling the height of each of four extending/retracting means that are provided around the player 45, two of them ahead and the other two behind the player.

Figure 5:
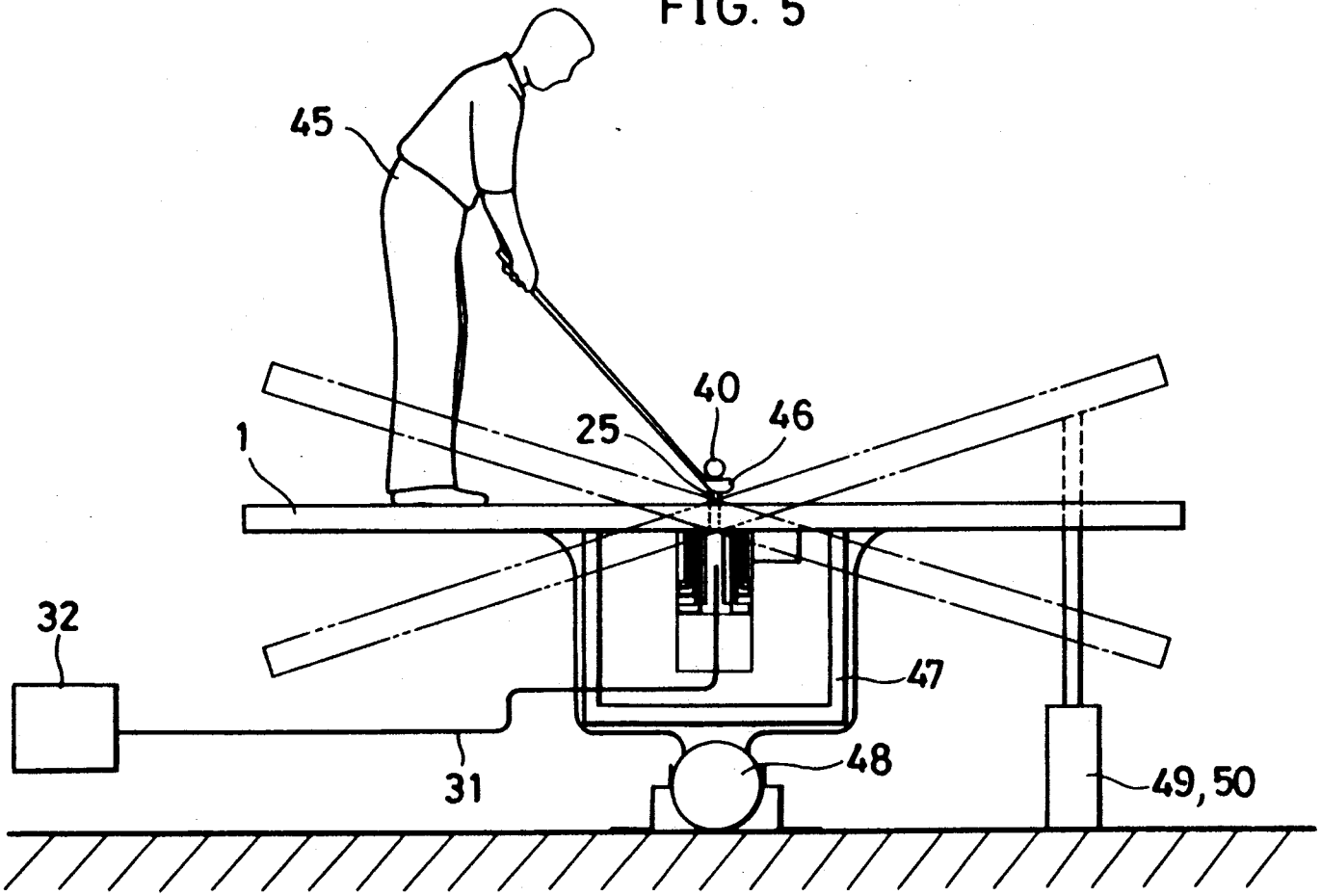
FIG. 5 is a side view showing in partial cross section the mechanism of tilting the floor.

An example of the advantageous structure for tilting the floor surface is described below with reference to FIG. 5. As shown in FIG. 5, a subhousing 47 that surrounds the vertical slider unit is provided beneath the floor 1 and this subhousing is supported by a ball bearing 48 in such a way that it is capable of rotating below the tee 25 in a direction normal to its axis. Two extending/retracting means 49 and 50 are installed between the ground and the floor at two points ahead of the player 45, one being on his right side and the other on his left. By this arrangement, the floor 1 is tiltably supported at three points, the ball bearing 48 and the two extending/retracting means 49 and 50. The extending-/retracting means may adopt any mechanism such as a hydraulic cylinder, driving with a motor or a threaded column that are capable of freely adjusting the height or length.

Figure 6:
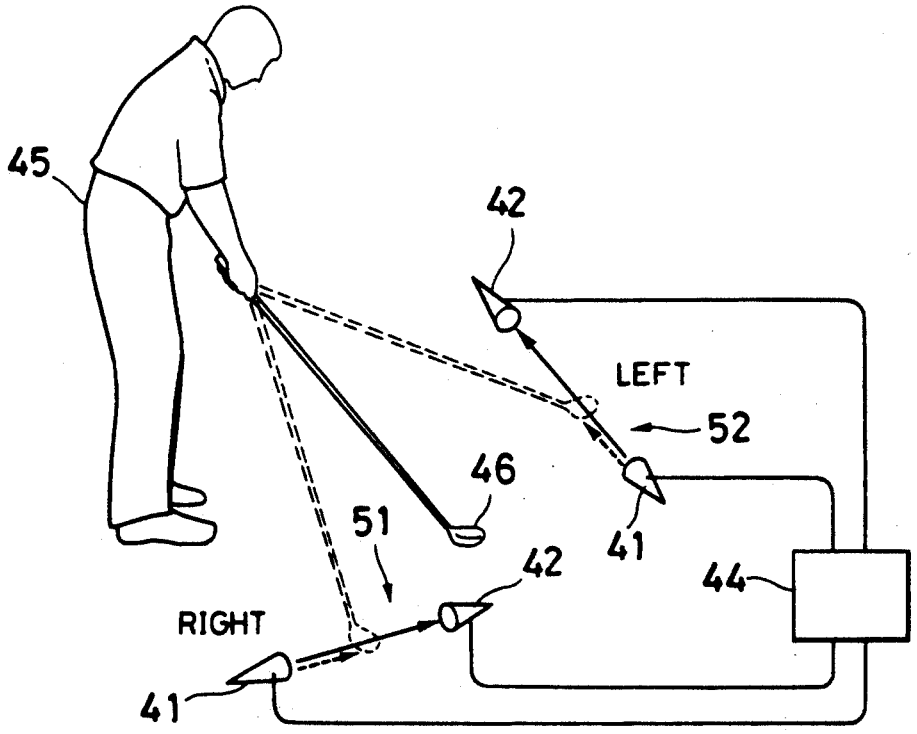
FIG. 6 is a diagram illustrating the mechanism of adjusting the inclination of the floor.

With the above-described structure which is supported at three points, the player needs only to control the two extending/retracting means 49 and 50 for changing the inclination of the floor three-dimensionally in such a way as to create a desired floor surface that simulates the condition of an actual golf course. The method of tilting the floor in a controlled manner is described below with reference to FIG. 6 and the following description centers on control by the extending-/retracting means 50 which is on the right side of the player. Referring to FIG. 6, numeral 51 denotes a control means for the extending/retracting means 50 and 52 signifies a control means for the extending/retracting means 49 on the left side of the player. Each of these control means is composed of a light-emitting device 41 and a light-receiving device 42 as in the case shown in FIG. 4 and the method of control by those means is also the same as described with reference to FIG. 4. To reiterate briefly, the player 45 will first put the head 46 of his club between the two devices 41 and 42, whereupon the extending/retracting means 50 moves vertically between the upper and lower limits; the player then removes the head from between the devices 41 and 42, whereupon the extending/retracting means 50 stops at the position it has attained by the time when the head is removed. These movements of the means 50 are also controlled with the aid of the automatic control unit 44 which has been described with reference to FIG. 4. A tilting floor surface of a desired inclination can be realized by successively manipulating the control means 51 and 52 in association with the respective extending/retracting means 49 and 50.

Figure 7:
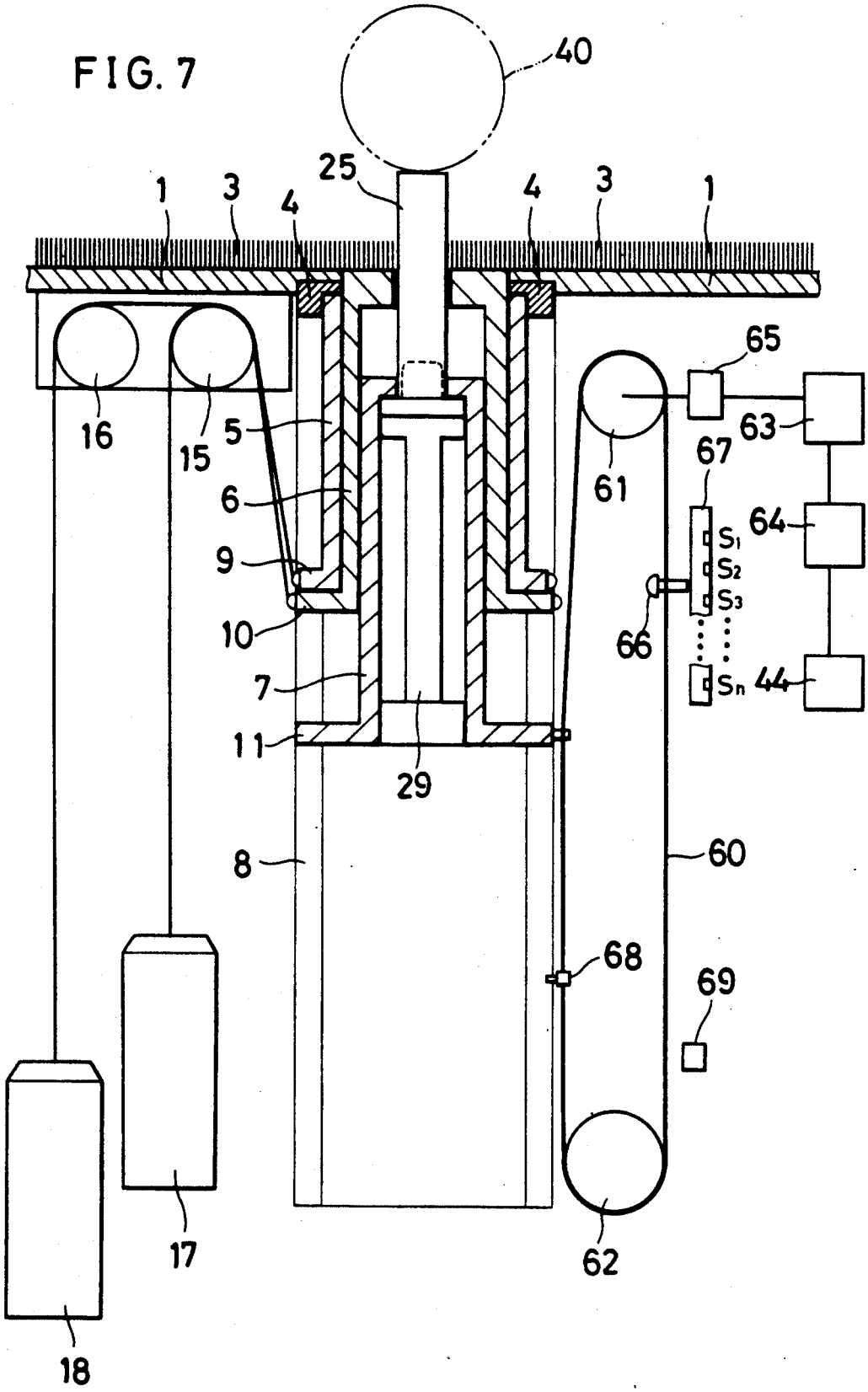
FIG. 7 is a side view showing in partial cross section the essential part of the drive mechanism of the golf practicing apparatus of the present invention.

We now describe the mechanism of driving the vertical slider unit. As shown in FIG. 7, the flange 11 of the inner tube 7 of the slider unit is linked to a chain 60, which is wound onto a driven ratchet wheel 61 and a freely rotating ratchet wheel 62, with the ratchet wheel 61 being driven by means of a clutch 63 and a motor 64 under the control of the automatic control unit 44. In order to perform precise control over the height of the tee and the inclination of the floor, a precision motor capable of good response must be used as the motor 64. For better response, the motor 64 is preferably equipped with a brake 65. The chain may be replaced by a wire, a thin rod or any other member that will experience small elongation. In the case shown in FIG. 7, the slider drive means is composed of weights 17 and 18, as well as a series of the necessary elements including the chain 60, clutch 63, motor 64 and brake 65. However, this is not the sole case of the present invention and any other mechanism that is capable of sequential vertical movements of the outer, intermediate and inner tubes of the slider unit may be employed. To name a few examples, an air cylinder and a hydraulic cylinder may be adopted.

The vertical slider unit shown in FIG. 7 is in the hitting position with a ball teed up. In this state, a contractor 66 on the chain 60 allows one of the switches $S_1$, $S_2$, $S_3$, . . . , $S_n$ in a switch assembly 67 to conduct so that the tee is adjusted to the height indicated in FIG. 7. In other words, the respective switches in the switch assembly 67 are used to adjust the height of the tee to predetermined levels. The switch assembly 67 is electrically connected to the automatic control unit 44. As already described with reference to FIG. 4, if the player puts the head 46 of his club between the light-emitting device 41 and the light-receiving device 42 of the control means 43, the control unit 44 starts to drive the motor 64, causing the chain 60 to rotate. As a result, the contactor 66 reciprocates along the switch assembly 67 under the control of the unit 44, whereby the tee is accordingly moved up or down. For example, switch $S_1$ corresponds to a height at which the tee 25 is buried in the artificial lawn grass 3 and the height of the tee increases in the order of $S_2$, $S_3$, . . . , $S_n$, with $S_n$ corresponding to a maximum height for the case where the tee is pegged into the tee ground.

The chain 60 is also fitted with a contactor 68. When the chain 60 rotates in such a direction that the inner tube 7 descends (goes downward as viewed in FIG. 7) until the contactor 68 allows a switch 69 to conduct, the resulting signal is supplied to the control unit 44, which brings the motor 64 to a stop and the slider unit comes to rest at the lowest position shown in FIG. 1.

In the manner described above, the drive unit insures that the slider unit comprising the outer tube 5, intermediate tube 6 and the inner tube 7 will move vertically in a controlled way between the lowest position (as shown in FIG. 1) and the hitting position (as shown in FIG. 2), with the height of the tee 25 being also controlled by the drive unit when the slider unit is in the hitting position (as shown in FIG. 7).

A mechanism for controlling the height of the tee in the hitting position may be installed separately from the above-described drive mechanism. In this case, it has to operatively synchronize with the drive mechanism under control of the control unite 44.

As a summary of the foregoing discussion, we now describe a cycle of operations that are performed by the golf practicing apparatus of the present invention, which start with the supply of a ball in the lowest standby position, the ball being then teed up automatically to the hitting position and the vertical slider unit returning to the initial standby position after the ball is struck with a club. In reading the following description, reference should be made to FIGS. 8–12, as well as FIG. 13 which is a flow-chart of all the operations involved.

Figure 8:
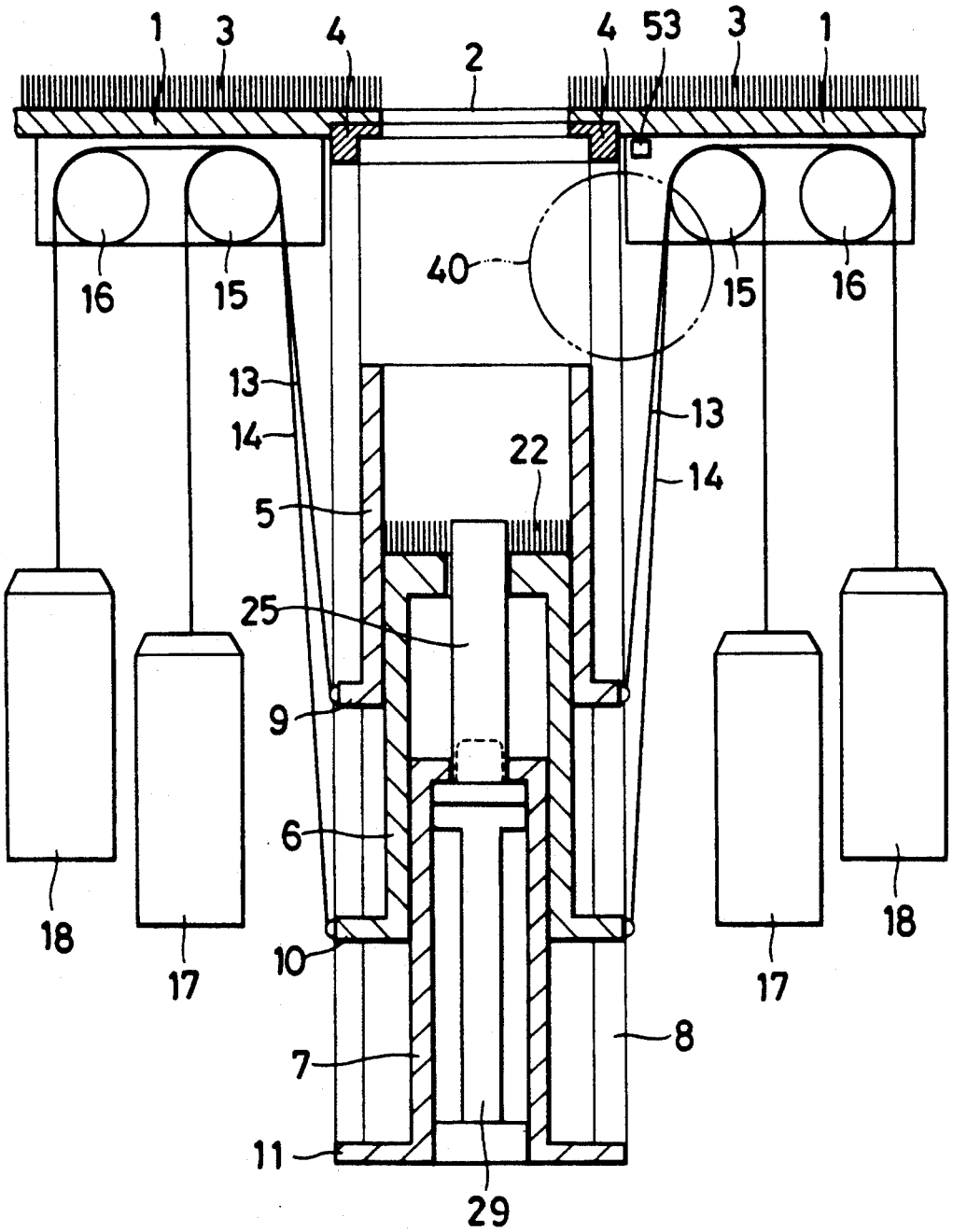
FIG. 8 shows, in combination with FIGS. 9-12, a cycle of successive movements of the vertical slider unit in the golf practicing apparatus of the present invention as illustrated by the flowchart of FIG. 13, with FIG. 8 depicting the state in which the vertical slider unit is in the lowest standby position.

FIG. 8 shows the vertical slider unit as it is in the lowest standby position where it waits for a ball to be supplied. In this state, the contactor 68 on the chain 60 in the slider drive mechanism permits the switch 69 to conduct so that the vertical slider unit rests in its lowest position. At the same time, the inner tube 7 pushes down the intermediate tube 6 and the outer tube 5 to the lowest position in counteraction against the weights 18 and 17 that are provided for the tubes 6 and 5, respectively. The automatic ball feeder 39 is installed between the top of the outer tube 5 and the floor 1.

Figure 9:
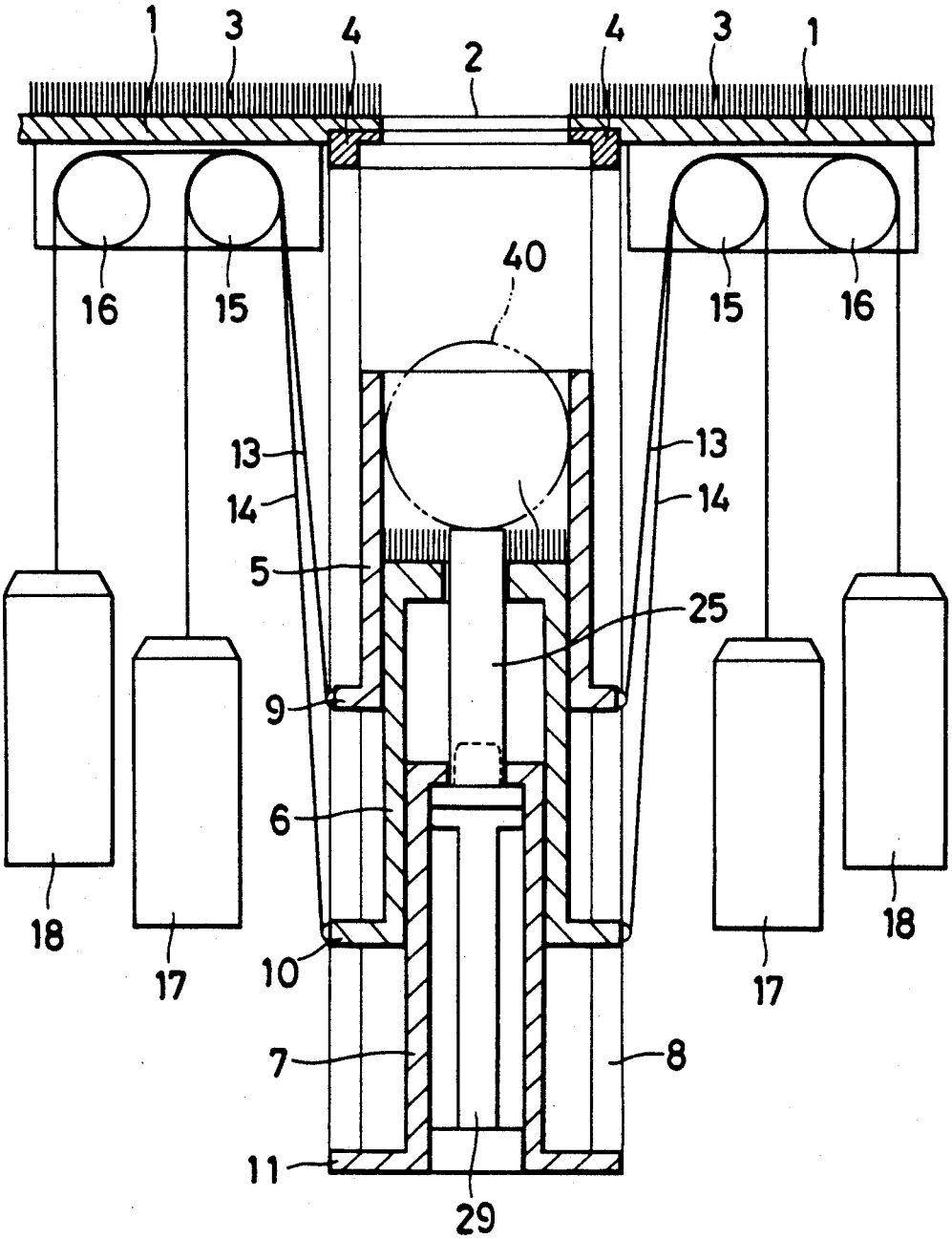
FIG. 9 shows the state in which a ball is placed on the tee in the lowest standby position shown in FIG. 8.

With the slider unit being in the state shown in FIG. 8, the player uses his fingers or the head of his club to drop a ball 40 into the through-hole 2 in the floor 1. Alternatively, the ball 40 is supplied from the automatic feeder 39 toward the open top end of the outer tube 5. In the case shown in FIG. 8, the ball is being supplied from the automatic feeder 39. The supplied ball is seated on the tee 25 as shown in FIG. 9. The supply of the ball is detected with a ball sensor 53 and the resulting signal is supplied to the automatic control unit 44. In response to this signal, the motor 64 drives the chain 60 in such a direction that the inner tube 7 will ascend.

Figure 10:
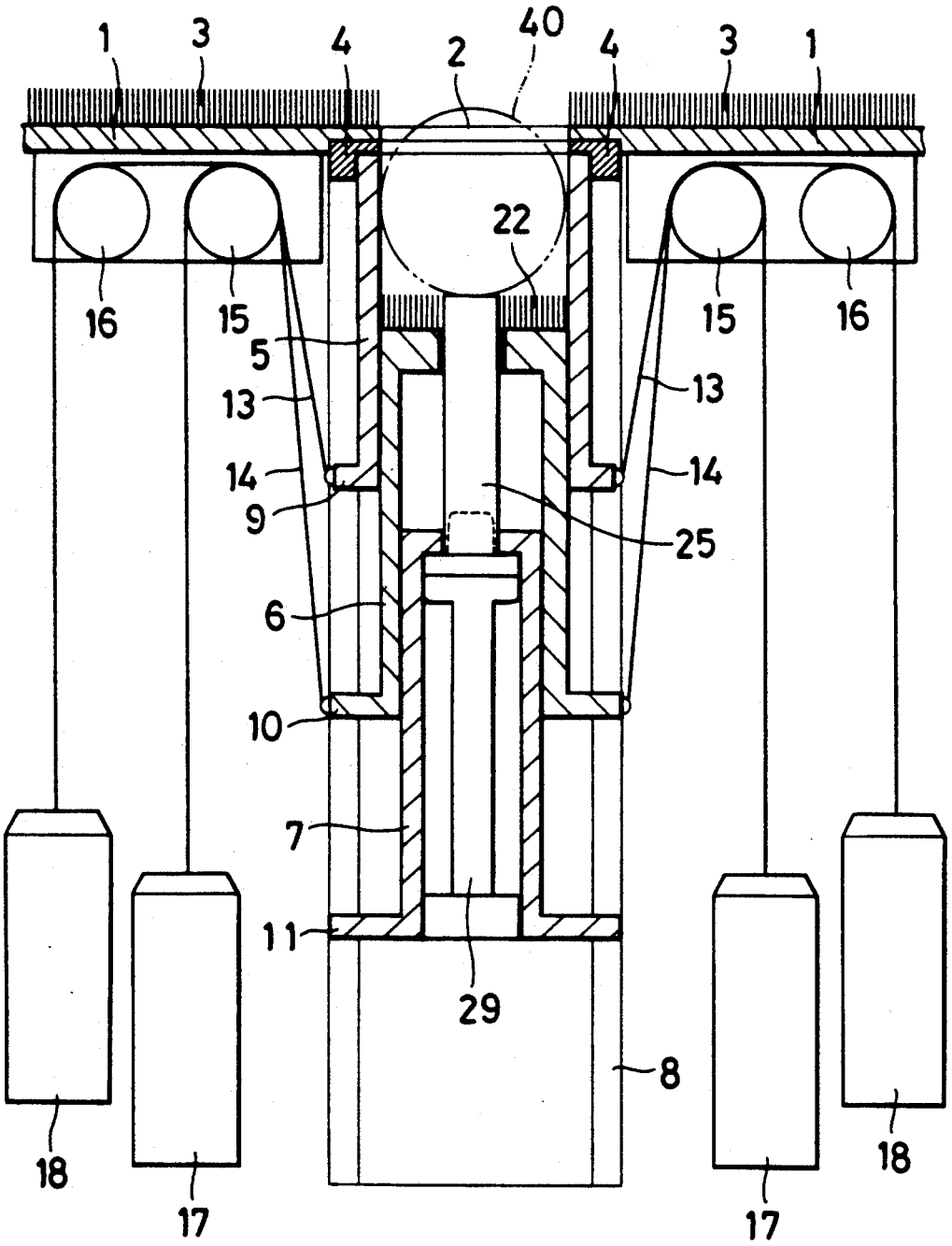
FIG. 10 shows the state in which the tee carrying the ball as shown in FIG. 9 ascends slowly.

If the chain 60 is further driven in the same direction, the top end of the outer tube 5 ascends until it contacts the stopper 4 as shown in FIG. 10. The intermediate tube 6 and the outer tube 5 are caused to ascend under the associated weights 18 and 17, respectively. If the outer tube 5 is fitted with the coil spring 37 on its circumference, the coil spring 37 will first contact the stopper 4 and then the top end of the outer tube 5, counteracting the spring force, will make a smooth and soft contact with the stopper 4.

Figure 11:
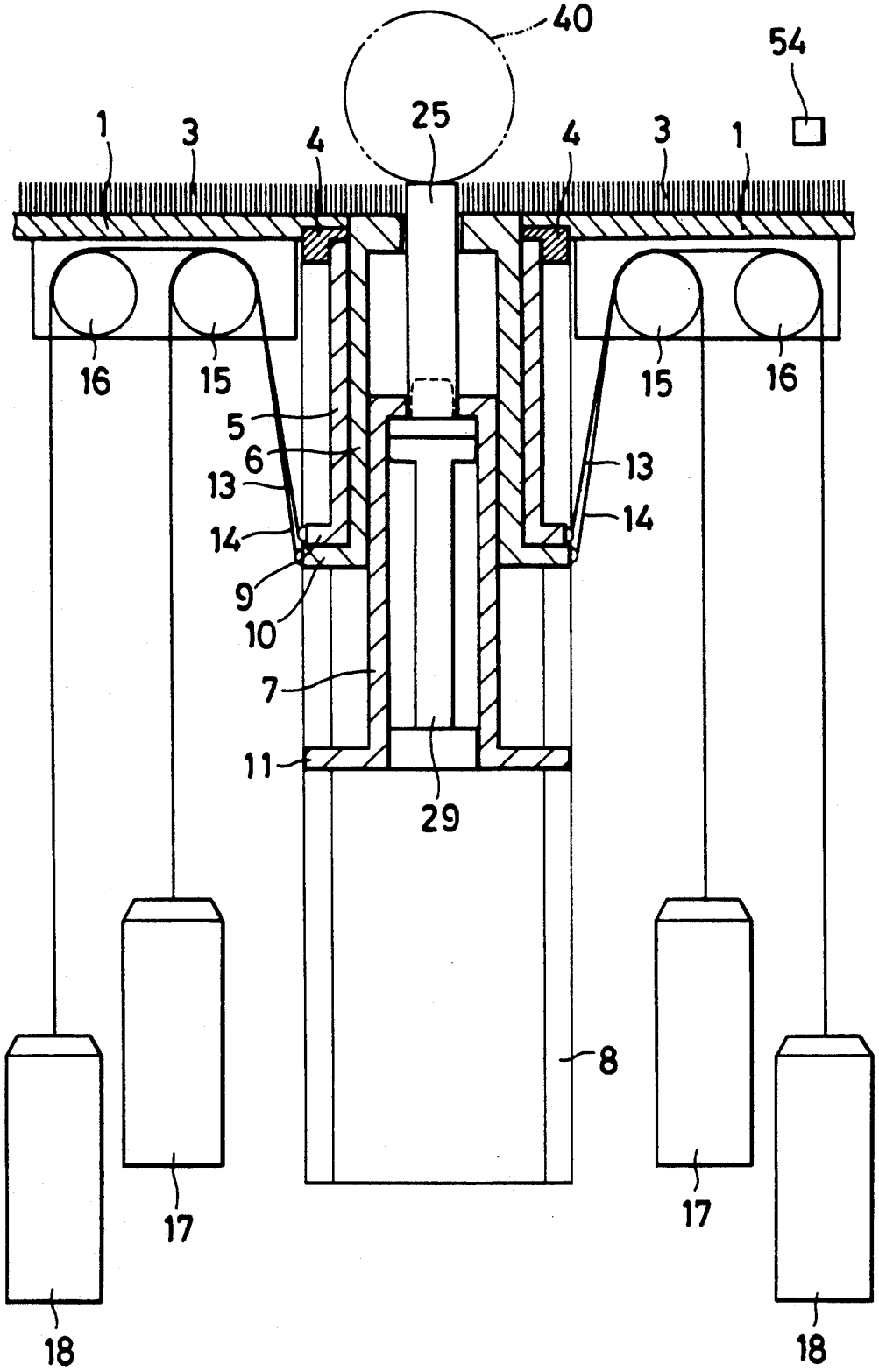
FIG. 11 shows the state in which the vertical slider unit stops with the top face of the intermediate tube being flush with the floor surface, so that the tee carrying the ball has ascended to the same level as the artificial lawn grass provided on the floor of the apparatus.

As the chain 60 is further driven in the direction that causes the inner tube 7 to ascend, the intermediate tube 6 will ascend under the associated weight 18 until the flange 10 will contact the flange 9 of the outer tube 5. As a result, the closed top 21 of the intermediate tube 6 will provide a surface that is flush with the top of the floor 1, whereby said closed top 21 will completely close the through-hole 2 in the floor 1. The artificial lawn grass 3 on the floor 1 then becomes continuous to the artificial lawn grass 22 on the closed top 21 and only the tee 25 projects beyond the continuous patch of artificial lawn grass, as shown in FIG. 11. If the intermediate tube 6 is fitted with the coil spring 38 on its circumference, the impact that occurs when the flange 10 of the intermediate tube 6 contacts the flange 9 of the outer tube 5 is effectively absorbed by the spring 38 so that the ball 40 will not drop from the tee 25 nor will any undesired mechanical noise be heard.

Figure 12:
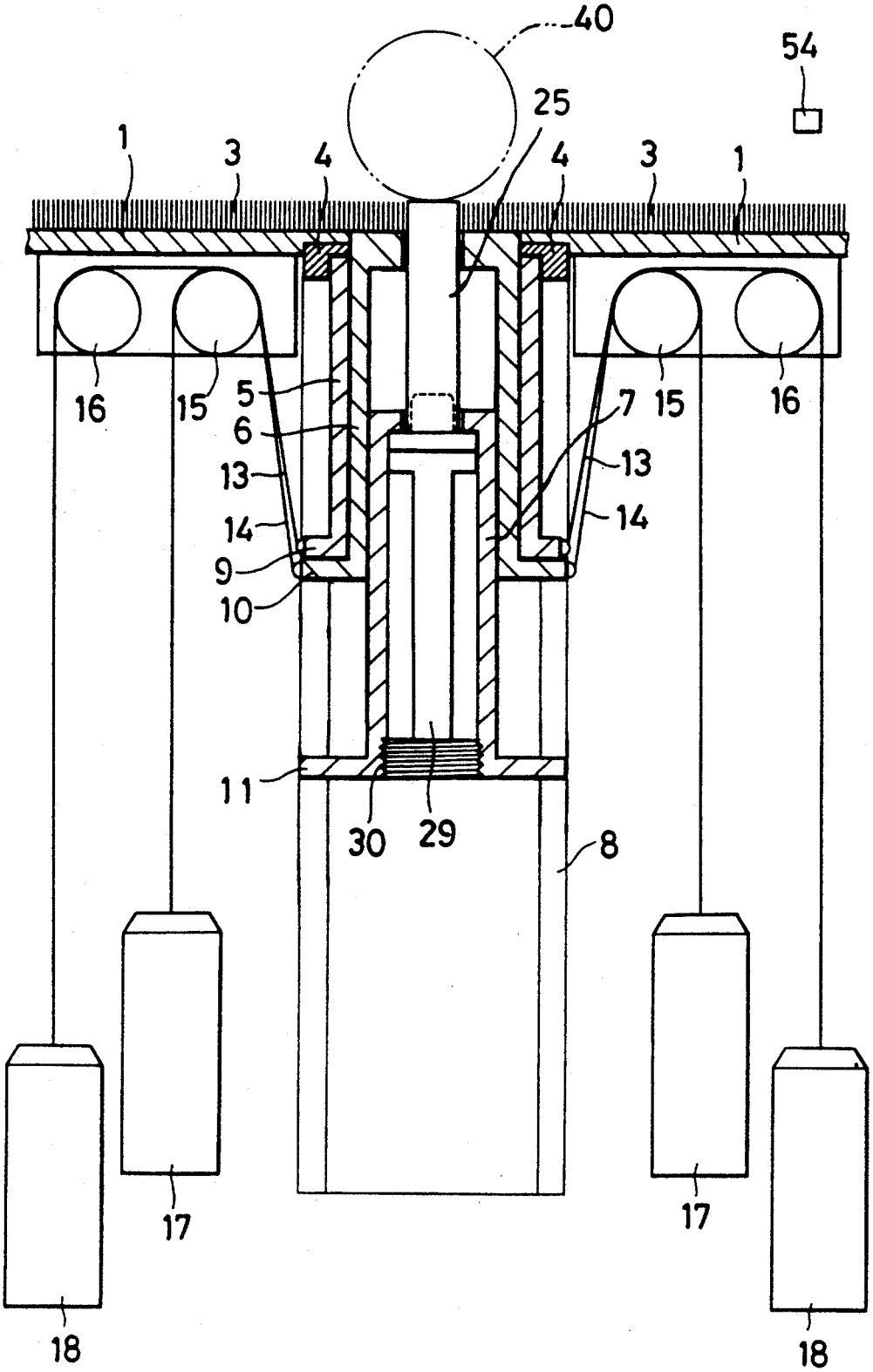
FIG. 12 shows the state in which the ball carrying tee has ascended to the highest hitting position from the state shown in FIG. 11.
Figure 13:
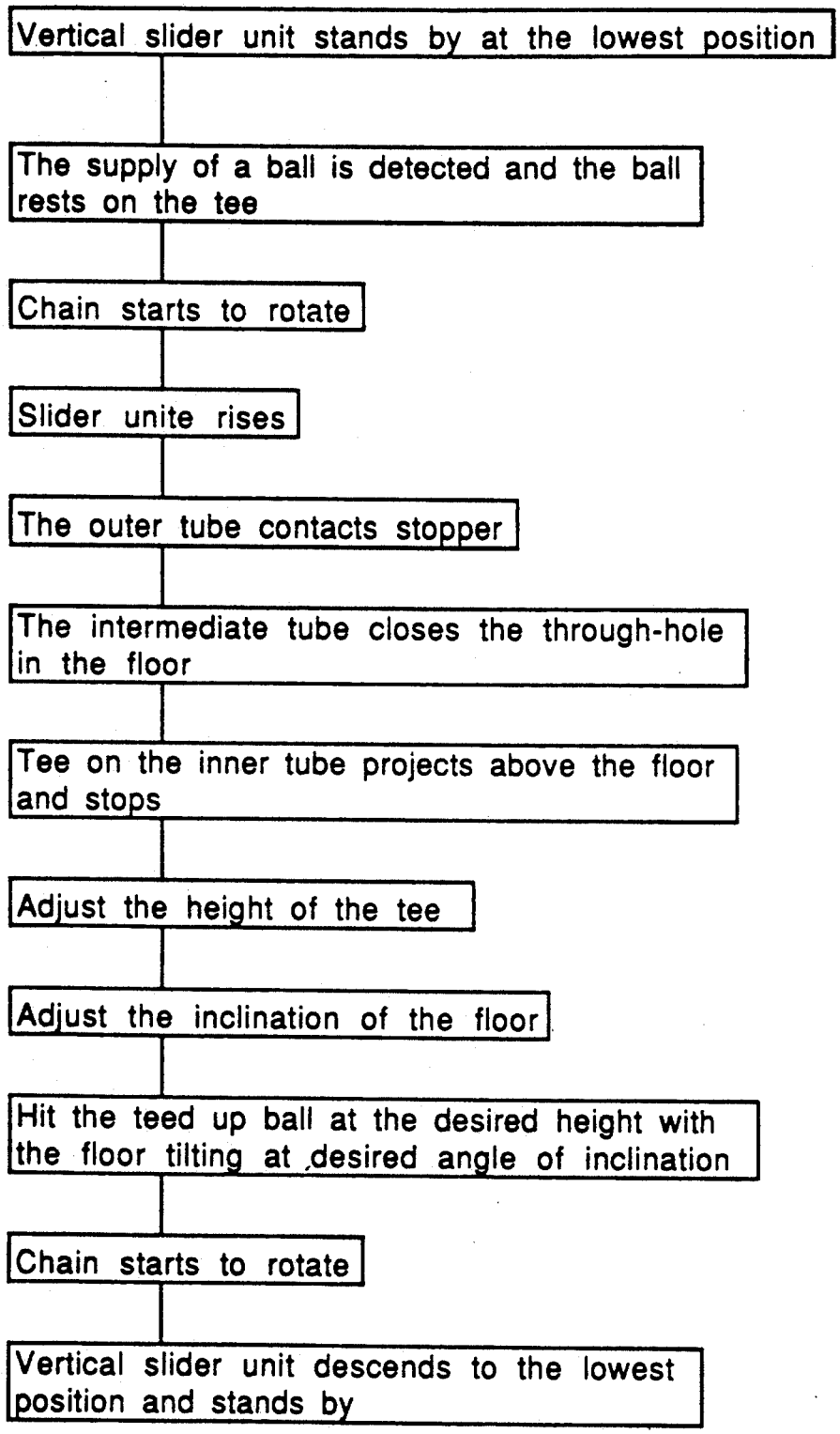
FIG. 13 is a flowchart showing a cycle of movements of the vertical slider unit starting at the lowest standby position where a ball is supplied, passing the state where the ball is automatically teed up to the hitting position and ending with the state in which the tee returns to the standby position after ball is hit.

In the situation described above, the contactor 66 on the chain 60 will contact either one of the switches $S_1$, $S_2$, . . . , $S_n$ in the switch assembly 67, whereupon the chain 60 stops rotating at the position corresponding to the contacted switch and the tee 25 also stops at the hitting position shown in FIG. 11. This position at which the tee 25 stops is one of the positions the tee can assume for enabling the player to strike the teed up ball. As shown in FIG. 12, the position of the tee can be varied to the highest hitting position at which the closed top 21 of the inner tube 7 contacts the closed top 19 of the intermediate tube 6.

The height of the tee in the hitting positions shown in FIGS. 11 and 12 can be controlled by the same method as already described with reference to FIG. 4. If the player 45 puts the head 46 of his club between the light-emitting device 41 and the light-receiving device 42, the emitted light is blocked and the resulting signal causes the control unit 44 to drive the chain 60 so that the contactor 66 on the chain 60 will selectively contact either one of the switches in the switch assembly 67, whereupon the tee 25 is moved either upward or downward to the height associated with the contacted switch. If the tee is moved to a desired height, the player will remove the head 46 of his club from between the light-emitting device 41 and the light-receiving device 42 and the tee will accordingly stop at the position it has reached by the time the head is removed. This completes the process of making the teed up ball ready for being struck.

If the player strikes the ball 40 on the tee 25 which has been adjusted to a desired height, the tee 25 no longer carries a ball. A ball sensor 54 detects the presence of a ball 40 if it is carried on the tee 25 being raised from the floor; the sensor also keeps detecting the presence of the ball on the tee while its height is adjusted. However, as long the sensor 54 keeps detecting the presence of the ball on the tee, the resulting signal will never allow the control unit to initiate some operation.

However, if the sensor 54, after having detected the presence of a ball on the tee, finds that the ball is struck and that it is no longer on the tee, the signal indicating that event will cause the control unit 44 to drive the chain 60 in such a direction that the inner tube 7 will descend. If the chain 60 is kept driven in the same direction until the contactor 68 on the chain 60 contacts the switch 69, the resulting signal will cause the control unit 44 to stop the driving of the motor 64 and the brake 65 acts on the ratchet wheel 61 to insure that the rotation of the chain 60 will be brought to a stop in a smooth way. As a result, the slider unit will rest at the lowest position shown in FIG. 8 and waits for the next ball to be supplied.

When the slider unit stops at one of the hitting positions illustrated in FIG. 11 or 12 and the teed up ball is ready for being struck, the player, if he so desires, may put the head 46 of his club between the light-emitting device 41 and the light-receiving device 42 in the same manner as already described with reference to FIG. 6, whereby the extending/retracting means 49 and 50 which support the floor 1 are properly controlled to tilt it by a desired angle of inclination. By striking the ball on the thus inclined floor, the player can have the same experience as he would be in an actual golf course. In this case, the tee also tilts and the ball can potentially drop from the tee. To prevent this problem, the evacuating device 32 is preferably used to suck the ball from within the tee. Even if no tilting surfaces are to be created, the ball is advantageously sucked by the evacuating device to minimize the chance of it dropping from the tee.

The golf practicing apparatus of the present invention enables balls to be consecutively teed up automatically. Having capabilities for adjusting the height of the tee and the inclination of the floor, the apparatus allows the player to practice hitting balls with woods and irons under substantially the same condition as in an actual golf course. The conventional practicing apparatus designed for automatically teeing up balls has a fairly large hole made in the area where balls are to be teed up. This hole is obtrusive since it comes into the view of the player when he hits balls; at the same time, his club or hands are unavoidably damaged if the top edges of the hole are struck with an iron. The apparatus of the present invention is entirely free from these problems.

What is claimed is:

1. A golf practicing apparatus comprising:

(1) a vertical slider unit having a ball support tee, said unit being mounted beneath a through-hole in a floor, said floor having a substantially horizontal planar upper surfaces and said unit being vertically movable between a lower position for receiving a golf ball to be positioned on said support tee and an upper position where the golf ball can be hit from said support tee;

(2) means for moving said slider unit between said lower and upper positions; and (3) means for automatically controlling sequential vertical movement of said slider unit between said lower & upper positions;

said slider unit having:

(a) a vertically extending outer tube, said outer tube being open at both ends and in alignment with said through-hole in said floor when in said lower position and lower top surface which contacts an under-surface of said floor when in said upper position;

(b) a vertically extending intermediate tube slidably fitted in said outer tube, said intermediate tube having an open bottom and a closed top, said closed top having an orifice and forming a surface flush with said upper planar surface when said slider unit is in said upper position; and (c) a vertically extending inner tube slidably fitted in said intermediate tube, said inner tube having a closed top, said closed top having said ball support tee attached thereto such that said ball support tee will protrude through said orifice in said intermediate tube and said through-hole when said unit is in said upper position.

2. A golf practicing apparatus according to claim 1 wherein a patch of artificial lawn grass is detachably attached to said closed top of said intermediate tube.

3. A golf practicing apparatus according to claim 1 wherein the tee is detachably attached to said closed top of said inner tube.

4. A golf practicing apparatus according to claim 1 which further includes means for adjusting the height of the tee after it projects above the floor surface.

5. A golf practicing apparatus according to claim 1 wherein said tee is in tubular form and said apparatus has means for releasably holding a golf ball on said tee.

6. A golf practice apparatus according to claim 5 wherein said means for releasably holding a golf ball on said ball support tee is a device for creating air suction through the interior of said support tee.

7. A golf practicing apparatus according to claim 1 wherein said vertical slider unit has a guide tube for guiding said outer, intermediate and inner tubes.

8. A golf practicing apparatus comprising:

(1) a floor having a through-hole, said floor having a substantially horizontal planar upper surface;

(2) a vertical slider unit having a ball support tee, said unit being mounted beneath said through-hole in said floor, and said unit being vertically movable between a lower position for receiving a golf ball to be positioned on said support tee and an upper position where a golf ball can be hit from said support tee;

(3) means for moving said slider unit between said tower and upper positions;

(4) means for automatically supplying a golf ball to said ball support tee;

(5) means for automatically controlling sequential vertical movement of said between said lower and upper positions;

said slider unit having:

(a) a vertically extending outer tube open at both ends, said outer tube being and in alignment with said through-hole in said floor when in said lower position and having a surface which contacts the floor an under-surface of said floor when in said upper position;

(b) a vertically extending intermediate tube slidably fitted in said outer tube, said intermediate tube having an open bottom and a closed top, said closed top having an orifice and forming a surface flush with said upper planar surface of said floor when said slider unit is in said upper position; and (c) a vertically extending inner tube slidably fitted in said intermediate tube, said inner tube having a closed top, said closed top having said ball support tee attached thereto such that said ball support tee will protrude through said orifice in said intermediate tube and said through-hole when said unit is in said upper position.

9. A golf practicing apparatus according to claim 8 wherein a patch of artificial lawn grass in detachably attached to said closed top of said intermediate tube.

10. A golf practicing apparatus according to claim 8 wherein the tee is detachably attached to said closed top of said inner tube.

11. A golf practicing apparatus according to claim 8 which further includes means for adjusting the height of said tee after it projects above said upper floor surface.

12. A golf practicing apparatus according to claim 8 wherein said tee is in tubular form with said apparatus has means for releasably holding a golf ball on said tubular tee.

13. A golf practicing apparatus according to claim 12 wherein said means for releasably holding a golf ball on said ball support tee is a device for creating air suction through the interior of said support tee.

14. A golf practicing apparatus according to claim 8 wherein said vertical slider unit has a guide tube for guiding said outer, intermediate and inner tubes.

15. A golf practicing apparatus according to claim 8 which further includes means for tilting said floor.

16. A gold practicing apparatus according to claim 13 wherein said floor tilting means comprises a ball joint which supports said floor and said slider unit, said apparatus further having means to for selectively adjusting the height of said tee to a desired height after said slide unit has reached said upper position.

17. A golf ball practice apparatus according to claim 16 wherein said means for selectively adjusting the height of said tee is a light emitting and receiving device operably by a user of said apparatus.

* * * * *